United States Patent [19]

Langeman

[11] 4,349,296

[45] Sep. 14, 1982

[54] IRRIGATION DITCH GATE

[76] Inventor: Peter J. Langeman, Box 765, Coaldale, Alberta, Canada

[21] Appl. No.: 116,085

[22] Filed: Jan. 28, 1980

[51] Int. Cl.[3] ..... E02B 7/40

[52] U.S. Cl. ..... 405/99; 405/94; 49/386

[58] Field of Search ..... 405/87, 89, 92–95, 405/99; 49/386, 366, 10; 16/72, 76, 85

[56] References Cited

U.S. PATENT DOCUMENTS

| | | | |
|---|---|---|---|
| 664,078 | 12/1900 | Frank et al. | 405/99 X |
| 1,006,730 | 10/1911 | Dougherty et al. | 405/87 |
| 3,142,095 | 7/1964 | Sawyer | 49/386 X |
| 3,894,356 | 7/1975 | Imhoff | 49/366 |

*Primary Examiner*—Price C. Faw, Jr.
*Assistant Examiner*—Nancy J. Pistel
*Attorney, Agent, or Firm*—William R. Hinds; George H. Dunsmuir

[57] ABSTRACT

A gate for an irrigation ditch includes a rectangular frame, in which a pair of gates are pivotally mounted on shafts for rotation around vertical axes at the sides of the frame; helical springs connected to the top ends of the shafts and to the frame for regulating the water pressure required to open the gates; and tensioning elements for changing the length and consequently the tension of the springs, so that the pressure required to open the gates can be adjusted.

9 Claims, 6 Drawing Figures

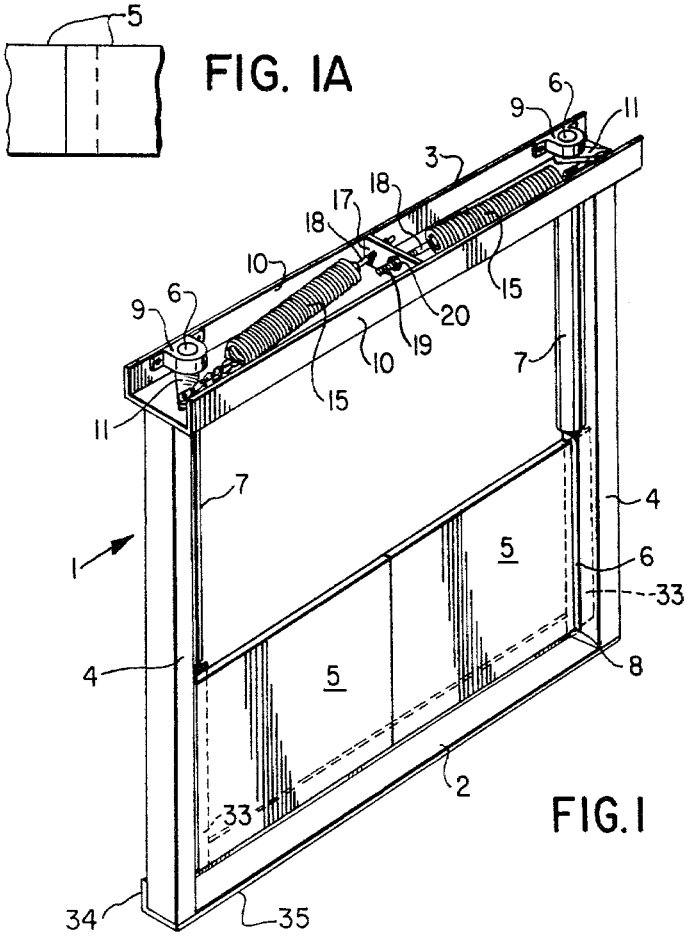
FIG. I
FIG. 2
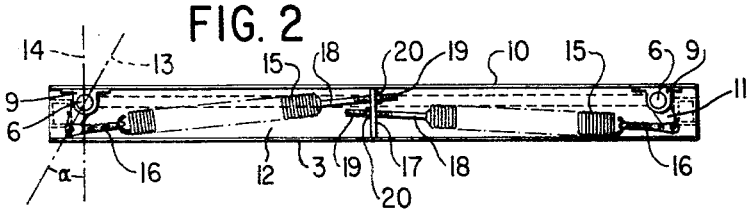
FIG. 3
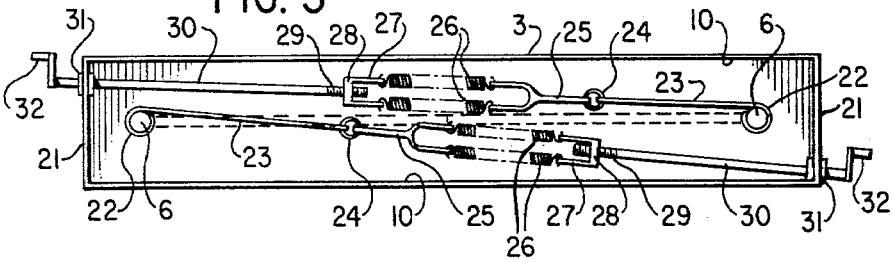

IRRIGATION DITCH GATE

BACKGROUND OF THE INVENTION

This invention relates to a gate for use in the control of water levels in water reservoirs, sewage ponds, power dams, irrigation ditches and the like. More particularly, the present invention is directed to a gate for use in an irrigation system, and specifically for maintaining the water in an irrigation ditch at a predetermined, constant level.

The field of gates for irrigation ditches is not particularly active. A review of the patent art in the field discloses relatively few patents, including U.S. Pat. Nos. 116,247, issued to H. O. Way on June 20, 1871; 664,078, issued to E. S. Frank et al on Dec. 18, 1900; 850,441, issued to T. J. McGinnis on Apr. 16, 1907; and 994,210, issued to E. F. Rhodes on Dec. 21, 1909. In general, the gates disclosed by the patents are flood gates, which rely on somewhat bulky spring structures which are not adjustable except by major alterations.

More importantly, the prior art gates are not designed to prevent flow therethrough and do not serve to keep the water level at a constant or predetermined level.

It is readily apparent that there is a need for a simple gate for use in irrigation ditches. The object of the present invention is to provide a relatively simple gate, which opens automatically under a predetermined water pressure to control the level of water in the ditch.

SUMMARY OF THE INVENTION

Accordingly, the present invention relates to a gate for an irrigation ditch comprising a frame for mounting in the ditch; gate means pivotally mounted in said frame for rotation between open and closed positions; helical spring means connected at one end to said frame means and at the other end to said gate means for biasing said gate means to the closed position; and tension means for adjusting the spring tension, so that the pressure required to open said gate means can be adjusted.

BRIEF DESCRIPTION OF THE INVENTION

The invention will now be described in greater detail with reference to the accompanying drawings, which illustrate preferred embodiments of the invention, and wherein:

FIG. 1 is a perspective view from above and one side of one embodiment of gate in accordance with the present invention;

FIG. 1A is a fragmentary elevational view showing overlap of the pair of gates at their free edges;

FIG. 2 is a plan view of the gate of FIG. 1;

FIG. 3 is a plan view of a second embodiment of gate in accordance with the present invention;

DESCRIPTION OF THE PREFERRED EMBODIMENT(S)

Figure 4:
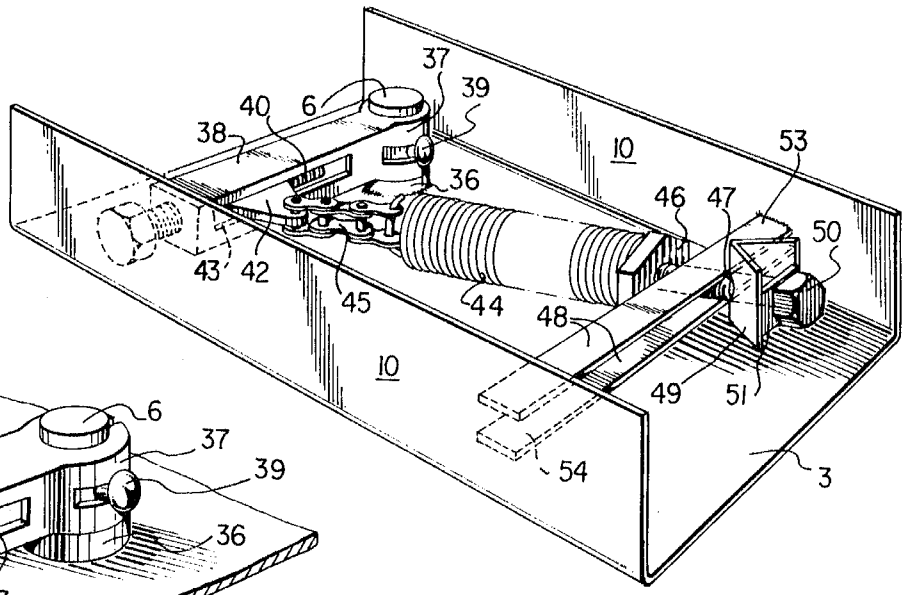
FIG. 4 is a perspective view from above and one end of the top of a gate illustrating alternate tension elements for use in the apparatus of FIGS. 1 and 2.

With reference to FIGS. 1 and 2 of the drawing, the gate of the present invention includes a frame generally indicated at 1 defined by a bottom wall 2, a top wall 3, and side walls extending between the ends of the bottom and top walls. The bottom wall 2 has an L-shaped cross-sectional configuration, and the side walls 4 are defined by tubes having a rectangular cross-sectional configuration. In use the frame 1 is installed at a point in an irrigation channel or ditch where a constant level of water is required, the side walls 4 defining the sides of the ditch. The frame 1 can be installed in an opening in a cement dike or weir (not shown) or in any other check structure.

A pair of gates 5, which may overlap at their free inner edges as shown in FIG. 1A, are mounted on shafts 6 in the frame 1. The bottoms of the shafts 6 rest on the bottom wall 2 of the frame. The shafts 6 extend downwardly from and are pivotally mounted in cylindrical sleeves 7, which are mounted on the inner surfaces of the side walls 4. Each shaft 6 is mounted on a needle bearing (not shown), and extends upwardly from a socket 8 in the bottom wall 2 through the top wall 3 to a bearing 9 of the pillow block-type. The bearings 9 are mounted on a vertical side or flange 10 of the top wall 3 near the ends thereof.

A lever 11 extends inwardly, i.e. over portion 12 of the top wall 3 from each shaft 6. The outer end of the lever is connected to the top end of the shaft 6 beneath the bearing 9 for rotation with the shaft 6. Longitudinal axis 13 (FIG. 2) of the lever 11 defines an angle of 40° to 60° with respect to a line 14 through the centre of the shaft 6 and perpendicular to the plane of the frame 1 and gates 5. A helical spring 15 is connected to the inner end of the lever 11 by a chain 16. The spring 15 extends towards the centre of the frame 1, and is connected to a crossbar 17 by a rod 18. The crossbar 17 extends between the flanges 10. The outer end 19 of the rod 18 is threaded for receiving a nut 20 on the side of the crossbar 17 opposite the spring 15. By tightening the nut 20, the length and consequently the tension of the spring 15 can be changed.

Referring now to FIG. 3 of the drawing, an alternative embodiment of the gate will now be described. In the following description of the apparatus of FIG. 3, wherever possible, elements the same as or similar to elements of the apparatus shown in FIGS. 1 and 2 are identified by the same reference numerals as in FIGS. 1 and 2.

The alternative embodiment of FIG. 3 includes flanges 21 extending between the ends of the flanges 10 on the top wall 3. The bearings 9 are omitted from the top ends of the shafts 6, and the tensioning elements are different from those in the flood gates of FIGS. 1 and 2. One end 22 of a cable 23 is coiled around the top end of each shaft 6. The cable 23 extends towards the other side of the frame 1, and is connected by a loop 24 to a Y-shaped yoke 25. One end of a helical spring 26 is connected to the outer end of each arm of the yoke 25. The other ends of the springs 26 are connected to the outer ends of arms 27 of a U-shaped yoke 28. Threaded end 29 of a rod 30 is connected to the crossbar of each yoke 28. Each rod 30 extends outwardly through a bushing 31 in the flange 21, and is provided with a handle 32 on its outer end. By rotating the handles 32, the length and consequently the tension of the springs 26 can be adjusted. It will be appreciated that the yokes 25 and 27 can be omitted, and that the springs 26 can be replaced with a single spring connecting each rod 23 to a rod 30.

Referring again to FIGS. 1 and 2, the operation of the gate will now be described.

A flange 33 (shown in phantom outline in FIG. 1) extending inwardly from each side wall 4 in front of each gate, i.e. on the upstream side of each gate prevents the passage of water through gaps between the shafts 6 and side walls 4, and prevents the accumulation of debris on the shafts which would impede rotation of the shafts. The vertical arm or flange 34 (FIG. 1) of the bottom wall 2 prevents movement of the gates 5 in one direction and prevents the escape of water between the bottom of the gates 5 and the horizontal arm 35 of the bottom wall 2. A gap is purposely provided between the bottom of the gates 5 and the arm 35 to prevent binding of the gates. When the water pressure on the front sides of the gates is sufficiently high, the gates 5 open against the bias of the springs 15 or 26. As soon as the pressure drops sufficiently, i.e. after the level of water flowing in the ditch decreases, the springs force the gates 5 to close. By adjusting the tension of the springs 15 or 26, the pressure or water level required to open the gates 5 can be adjusted.

Figure 5:
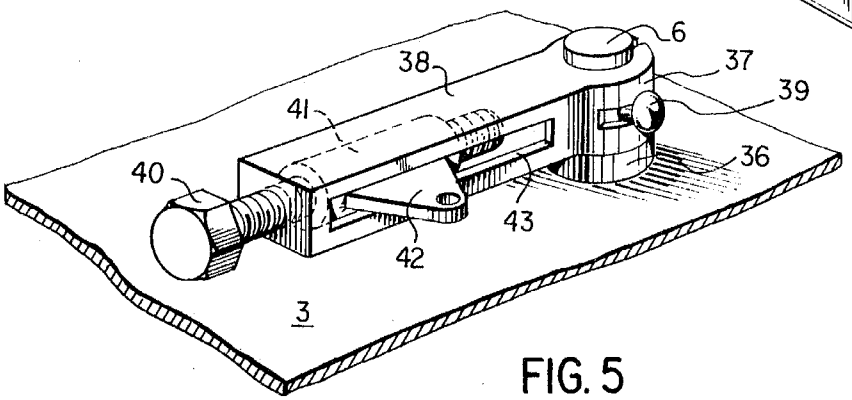
FIG. 5 is a perspective view on a larger scale of a lever portion of the tension elements of FIG. 4.

Referring now to FIGS. 4 and 5, the tension elements used to adjust the torque acting on the shafts 6 and thus the pressure required to open the gates 5 can be such that course or fine adjustments can be effected. In this alternate embodiment of the invention, the shafts 6 (only one shown) extend upwardly through sleeves 36 on the top wall 3 of the frame 1. A split ring 37 at one end of a lever 38 is connected to the top end of the shaft 6 by a bolt 39 and a nut (not shown) for rotation with the shaft. The body of the lever 38 is hollow for receiving a bolt 40, which extends through a threaded aperture in the outer closed end of the lever. An internally threaded sleeve 41 is mounted on the bolt 40 in the lever 38 for movement longitudinally of the sleeve when the bolt 40 is screwed into or out of the sleeve 41.

A lug 42 integral with the sleeve 41 extends outwardly through a longitudinally extending slot 43 in one side of the lever 38 and is connected to one end of a helical spring 44 by a chain 45. The outer end of the spring 44 is provided with a large nut 46 (or a plate containing a threaded aperture) which is permanently mounted on such spring. A bolt 47 extends into the nut 46 to tension and hold the spring in one direction. The bolt 47 extends between a pair of vertically spaced apart crossbars 48, which are connected to the vertical flanges 10 of the top wall 3. A V-shaped stop plate 49, with a plate 51 extending between and connected to its arms, is sandwiched between head 50 of the bolt 47 and the crossbars 48. As will be appreciated, in the position as shown in FIG. 4, when the gates open or close the angle of the spring changes in relation to the bars 48, thus the angular inclination of plate 49 will follow suit.

By loosening the bolt 47, the plate 49 can be moved and operatively positioned in a variety of locations between one end 53 of the crossbars 48 and the other end 54. With the plate 49 at end 53 of the crossbars 48, there is very little torque on shaft 6 and relatively low water pressure will open the gates 5. When the plate 49 is moved to the end 54 of the crossbars 48, torque on shaft 6 is high and consequently, the water pressure required to open the gates 5 is relatively high. It will therefore be clear that adjustment of the position of plate 49 along bars 48 can be made to suit operating requirements.

Fine adjustments of the pressure required to open the gates 5 can be made by turning the bolt 40. When the bolt 40 is turned, the sleeve 41 and the lug 42 move along the bolt 40 to change the effective length of the lever 38 and the pressure required to open the gates 5. Of course, the same elements are provided for each shaft 6. Thus, it is seen that this embodiment of the apparatus includes elements permitting coarse and fine adjustment of the pressure required to open the gates.

A pin or stop (not shown) may if required, be located on the top wall 3 of the frame for limiting movement of the lever 38 in one direction so that the gates will not completely close, thus permitting a certain amount of water to flow therethrough. The pin would however be positioned so as not to impede opening of the gate under normal operation. Positioning of this stop would however be a matter of design choice.

Thus, there has been described a relatively simple gate for an irrigation ditch when opens automatically under a predetermined water pressure. While the preferred embodiments of the invention include a pair of gates, it will be readily apparent that a single gate or more than two gates in side by side relation can be used in the water level control structure.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example equivalent elements may be substituted for those illustrated and described herein, parts may be used inependently of the use of other features, all as will be apparent to one skilled in the art after having the benefits of the description of the invention.

What I claim is:

1. A gate for automatically maintaining predetermined water levels in an irrigation ditch comprising a frame for mounting in the ditch; gates means pivotally mounted in said frame for rotation between open and closed positions to permit or prevent water flow therethrough; spring means connected to said frame means and to said gate means for continuously biasing said gate means to the closed position; and readily actuatable means for adjusting the spring bias, so that the pressure and hence the water level required to open said gate means against the spring bias can be adjusted.

2. A gate according to claim 1, wherein said gate means includes a pair of gates and shaft means on each side of said frame pivotally mounting one outer edge of each gate on one side of the frame such that free inner edges of the gates overlap at the centre of the frame.

3. A gate according to claim 2, wherein said frame includes a top wall, a bottom wall and side walls interconnecting the ends of the top and bottom walls; a crossbar on said top wall intermediate the ends thereof; bearing means pivotally mounting the top end of each shaft means in said frame; said spring means comprising a pair of helical tension springs; means connecting one end of each spring to said crossbar; and lever means interconnecting the other ends of the springs to the top ends of respective ones of the shafts.

4. A gate according to claim 3, wherein said means connecting each spring to the crossbar includes a threaded rod extending outwardly from said one end of each spring; the adjusting means including means on said threaded rod on the side of the crossbar opposite said spring for adjusting the spring tension.

5. A gate according to claim 2, wherein said spring means includes a pair of helical tension springs; means connecting one end of each spring to the top end of one said shaft means on one side of said frame; screw means connecting the other end of each spring to the other side of said frame; and said adjusting means comprises handle means on the outer free end of said screw means for adjusting the spring tension.

6. A gate according to claim 1 wherein said spring means comprises a tension spring connected at one end to said gate means at a point outwardly of the axis of rotation of said gate means, and said adjusting means comprises means for varying the distance between said axis and said point of connection so as to vary the torque imposed on said gate means by said spring.

7. A gate according to claim 1 wherein said spring means comprises a tension spring connected at one end to lever arm means projecting outwardly from the rotational axis of said gate means such that spring tension acting along the spring axis imposes a torque on said gate means through said lever arm means, and said adjustment means comprises means for varying the angle between said spring axis and the axis of said lever arm means so as to vary said torque in the closed gate position.

8. A gate according to claim 1 wherein said spring means comprises a tension spring connected at one end to lever arm means fixed to said gate means and projecting outwardly from the rotational axis of said gate means such that spring tension acting along the spring axis imposes a torque on said gate means through said lever arm means, the orientation between said spring axis and the lever arm axis being such that an acute angle is formed between them in the closed gate position and the angle decreases upon rotation of the lever arm means as the gate means is moved toward the open position, such that the effective length of said lever arm means decreases as spring tension increases during opening of said gate means.

9. A gate according to claim 1, mounted in an irrigation ditch so as to prevent flow of water therealong except when the water level exceeds a predetermined level below the upper edge of said gate means.

* * * * *